United States Patent [19]

Kurose

[11] B 3,999,398

[45] Dec. 28, 1976

[54] RETAINING WALLS

[75] Inventor: Masayuki Kurose, Nagasaki, Japan

[73] Assignee: Giken Kogyo Kabushiki Kaisha, Tokyo, Japan

[22] Filed: Sept. 9, 1974

[21] Appl. No.: 504,439

[44] Published under the second Trial Voluntary Protest Program on March 16, 1976 as document No. B 504,439.

[30] Foreign Application Priority Data

Sept. 12, 1973 Japan ..... 48-102919

[52] U.S. Cl. ..... 61/49; 61/37; 52/587; 403/175

[51] Int. Cl.[2] ..... E02B 3/04; E04C 1/10

[58] Field of Search ..... 61/39, 37, 50, 47, 49, 61/4; 52/587, 432; 403/218, 175, 178

[56] References Cited

UNITED STATES PATENTS

| | | | |
|---|---|---|---|
| 953,051 | 3/1910 | Muralt | 61/37 |
| 1,026,616 | 5/1912 | Stratton | 61/37 |
| 1,847,868 | 3/1932 | Everham | 61/37 |
| 2,863,682 | 12/1958 | Canepa | 403/175 |
| 3,490,242 | 1/1970 | Schnabel, Jr. | 61/39 |
| 3,541,798 | 4/1970 | Schnabel, Jr. | 61/39 |

FOREIGN PATENTS OR APPLICATIONS

| | | | |
|---|---|---|---|
| 509,877 | 6/1955 | Italy | 403/218 |
| 580,926 | 8/1958 | Italy | 403/175 |

*Primary Examiner*—Jacob Shapiro
*Attorney, Agent, or Firm*—Basile, Weintraub & Vanophem

[57] ABSTRACT

A retaining wall comprising a grid-shaped framework fabricated by a plurality of groups of members joined end to end in a vertically aligned relationship and another plurality of groups of members also joined end to end in a horizontally aligned relationship. The ends of the vertically positioned members meet the adjacent ends of the horizontally positioned members at right angles thereto to define a multiplicity of cruciform patterns which combine in a mutually overlapping manner to form the retaining wall.

9 Claims, 13 Drawing Figures

RETAINING WALLS

This invention relates to a retaining wall for protecting a riverbank, a cliff or any other slope.

There is known a retaining wall of the reinforced concrete construction having an L-shaped or inverted T-shaped vertical cross-section. This retaining wall is unsatisfactory in a number of respects. It is constructed to cover the whole surface of a section of the ground to be protected. This type of wall naturally requires a lot of materials, e.g., cement, and it is also a time-consuming job to construct such a wall.

In order to provide adequate protection, the wall must have a large thickness and a broad bottom surface which are sufficient to enable the wall to withstand a heavy earth pressure or, in some cases, a heavy combined pressure of earth and groundwater. This requires that a large quantity of earth be removed from a relatively large area to prepare a foundation large enough to support the wall. The preparation of such a foundation necessitates a great deal of time and labor, and often gives rise to a subsequent collapse of the ground in the area above that from which earth has been removed.

It is, therefore, an object of this invention to provide a retaining wall which can easily be fabricated from lightweight materials which lend themselves to mass-production at a low cost in a wide variety of dimensions.

It is another object of this invention to provide a retaining wall which is strong enough to withstand a heavy earth pressure since the wall is fabricated from relatively few kinds of materials each in a relatively small quantity.

It is still another object of this invention to provide a retaining wall which can easily be applied against a slope without necessitating the removal of a lot of earth therefrom.

It is a further object of this invention to provide a retaining wall of the grid-shaped construction which is well adapted for protection of a site where drainage is a critical problem.

Other objects and features of this invention will be apparent from the following description of preferred embodimments of the invention and the accompanying drawings in which.

Figure 1:
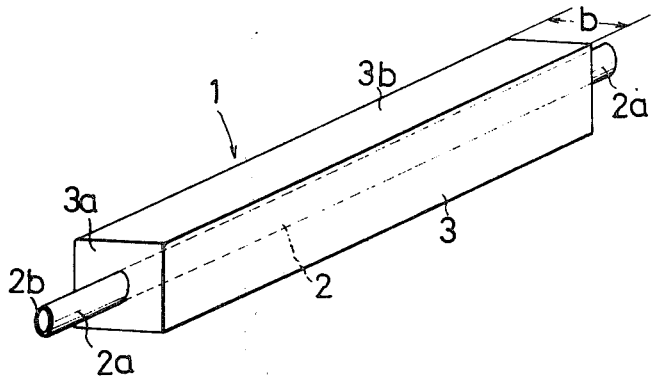
FIG. 1 is a perspective view of a form of the structural member used in the fabrication of the retaining wall of this invention.
Figure 2:
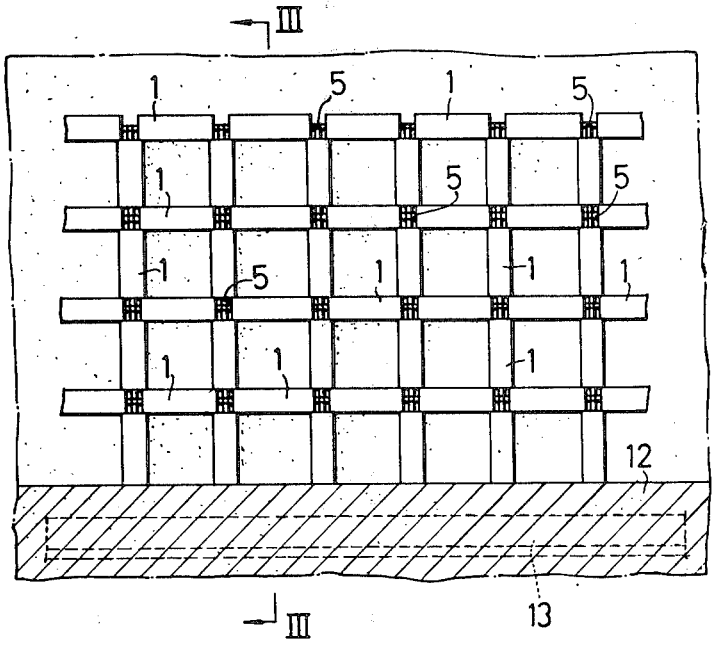
FIG. 2 is a front elevational view of a preferred embodiment of the retaining wall according to this invention.

Referring to the drawings, the retaining wall according to a preferred embodiment of this invention comprises a plurality of structural members 1 put together to form a grid-shaped structure as shown in FIG. 2. Each structural member 1 comprises an elongate core 2 and a likewise elongate body 3 secured to the core 2 as shown in FIG. 1. The core 2 is preferably made of steel and has a tubular shape in FIG. 1. The core 2 may, however, be of any other suitable shape. For example, the core 2 may be made of a steel channel or a round steel bar. The body 3 is preferably shaped in the form of a rectangular parallelepiped and is made of concrete molded around the core 2. The body 3 is somewhat smaller in length than the core 2, so that the opposite end portions 2*a* of the core project from the opposite ends 3*a*, respectively, of the body 3 in substantially coaxial relationship therewith to define means for connection with the adjoining members. The structural members 1 may be produced on a mass-production basis in a factory in as a wide a range of dimensions as desired. When one speaks of the dimensions of the members 1, the critical factor is apparently the dimensions of the body 3 insofar as the projecting end portions 2*a* of the core merely provide means for joining a plurality of members 1 together and the dimensions, particularly, the length, of the core 2 should naturally be varied to suit varying dimensions of the body 3. The dimentions of the members 1 depend upon the strength required of a particular retaining wall, which in turn depends upon the firmness of the ground at the site to be protected by the retaining wall and other possible natural conditions to which the retaining wall must be adapted. It would, however, be convenient to manufacture a multiplicity of members 1 having bodies 3 of different dimensions ranging from 25 cm to 45 cm in width, from 25 cm and 45 cm in height and from 100 cm to 200 cm in length in order to satisfy the varying requirements of the sites to be protected.

Figure 4:
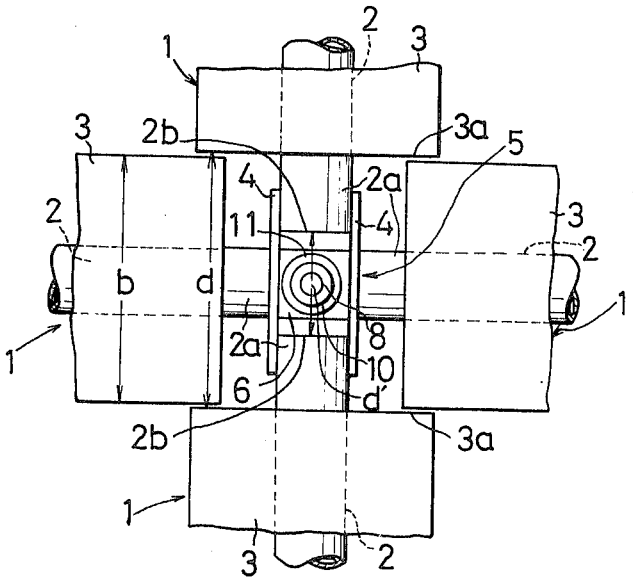
FIG. 4 is an enlarged fragmentary front elevational view of the retaining wall shown in FIG. 2.

As shown in FIG. 2, the structural members 1 are joined end to end in an overlapping cruciform pattern by connecting means 5 to form a grid shaped wall structure. Referring to FIG. 4, each of the connecting means 5 comprises a pair of vertically disposed parallel connecting plates 4 by which a pair of vertically aligned structural members 1 are connected. One of the connecting plates 4 is welded to the outer periphery of one of the projecting end portions 2*a* of one structural member 1 at one end, and to the corresponding portion of one of the end portions 2*a* of the other structural member 1 at the other end. The other connecting plate 4 is situated on the opposite side of the end portions 2*a* from the one connecting plate 4 and is welded thereto in a like manner. The ends 2b of the oppositely disposed tubular cores 2 are spaced from each other by a distance —*d'*—. The ends 3*a* of the bodies 3 are spaced from each other by a distance —*d*— which is slightly larger than the breadth —*b*— of the structural member 1 to provide a clearance for accomdating the ends 3*a* of the bodies 3 of another pair of structural members 1 which are horizontally disposed in mutual coaxial alignment.

The facing ends of the bodies 3 of the horizontally disposed structural members 1 slightly extend into the space defined by the distance —*d*—. The projecting core end portion 2*a* of one of the horizontal members 1 is welded to the outer side of one of the connecting plates 4. The care end portion 2*a* of the other horizontal member 1 is likewise welded to the outer side of the other connecting plate 4. The end portions 2*a* of the horizontal member 1 are aligned with each other along a line extending through the center of the distance —*d'*— between the vertical members 1. Thus, a pair of vertically disposed structural members 1 and a pair of horizontally disposed members 1 are joined with each other in a cruciform pattern. Progressive connection of additional structural members 1 in an overlapping cruciform pattern makes the retaining wall of the grid-shaped structure as shown in FIG. 2. No further description would be required in this regard.

The distance —d'— is preferably larger than the diameter of the projecting core end portion 2a of the structural member 1.

In the form shown in FIG. 4, the core end portion 2*a* of each horizontal member 1 is welded to one connecting plate 4 at the end 2*b* thereof. It is alternately possible, however, to provide a circular hole through each connecting plate 4 in the mid-portion thereof to receive the core end portion 2*a* of one horizontal structural member 1 and to be welded to the outer periphery thereof.

Figure 5:
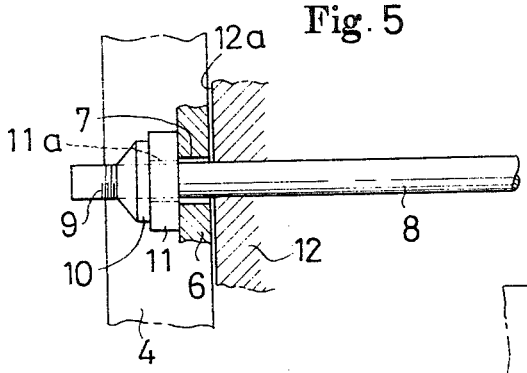
FIG. 5 is an enlarged fragmentary side elevational view of the retaining wall shown in FIG. 2.

The connecting means 5 further includes a square plate 6 interposed between the two connecting plates 4 and welded thereto at a pair of opposite edges. The square plate 6 is provided with a circular hole 7 in the center thereof as best shown in FIG. 5.

An elongate anchor bolt 8 extends through the hole 7 of the square plate 6 and is threaded at one end 9. An anchor head 10, which is similar to a nut, is screwed onto the threaded end portion 9 of the anchor bolt 8. A circular washer 11 is positioned between the square plate 6 and the anchor head 10 and has a centrally formed hole 11a through which the anchor bolt 8 extends. It will be understood that rotation of the head 10 about the threaded end portion 9 of the anchor bolt 8 causes the anchor bolt 8 to be axially disposed relative to the square plate 6. In FIG. 5, the washer has a diametrically uniformed thickness. It is, however, possible to use another type of washer having a gradually decreasing thickness along its diameter. This type of washer would be useful to position the anchor bolt 8 angularly relative to the square plate 6 to drive the anchor bolt 8 into the ground 12 at an angle to the surface 12*a* thereof. In order to permit such angular positioning of the anchor bolt 8, the hole 7 of the square plate 6 has a somewhat larger diameter than that of the anchor bolt 8 as illustrated in FIG. 5.

Figure 3:
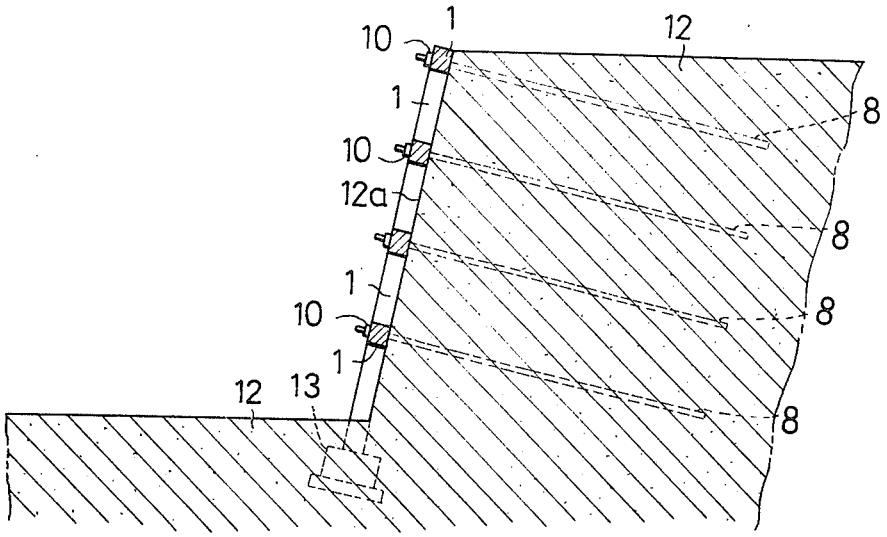
FIG. 3 is a vertical sectional view taken on the line III—III of FIG. 2.

The retaining wall is fabricated into a grid-shaped structure against the sloping surface 12*a* of the ground 12 exposed by removing an adequate minimum amount of earth therefrom. The elongate end of the anchor bolt 8 extending from the square plate 6 on the opposite side of the head 10 is driven into the ground 12 to hold the wall fast thereto. The length of that portion of the anchor bolt 8 which is driven into the ground 12 may be varied by rotating the head 10. The overall length of the anchor bolt 8 may largely depend upon the nature of the ground 12. The retaining wall is supported along the bottom edge thereof on a foundation 13 of any suitable construction buried in the ground 12 below the bottom of the slope 12*a* as illustrated in FIG. 3.

The anchor bolt 8 may conveniently be of the tubular construction to permit pouring of grout or the like therethrough into the ground 12 to ensure that the wall be held secure thereto. For the same purpose, it is alternatively possible to provide an enlarged head or flange on the inner end of the anchor bolt 8.

A multiplicity of windows defined by the structural members 1 may be left as they are to leave earth exposed therethrough. If desired, however, it is possible to close those windows by placing therein boulders, cobble stones or concrete blocks sized to suite the nature of the ground 12. Alternatively, it is all right to place concrete in those windows. Such additional reinforcement is, however, not generally required, because the retaining wall of this invention, per se, is strong enough to retain the slope 12a. The retaining wall of the grid structure is particularly advantageous to retain a site in which drainage is a serious problem. Because of its open window, underground water is free to flow out without necessitating any particular draining provisions.

Figure 6:
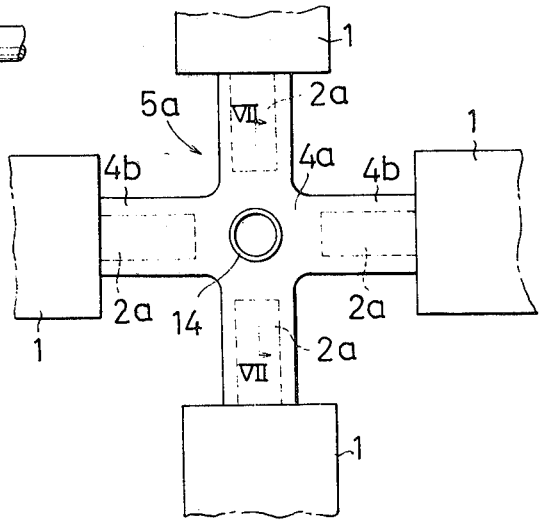
FIG. 6 is a fragmentary front elevational view of the retaining wall according to another embodiment of this invention.
Figure 7:
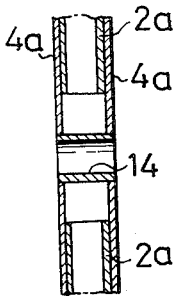
FIG. 7 is a vertical sectional view taken on the line VII—VII of FIG. 6.

Another form of connecting means 5*a* is shown in FIGS. 6 and 7 and comprises a pair of parallel cross-shaped connecting plates 4*a*. Each connecting plate 4*a* is provided with a circular hole in the central intersection thereof. A short pipe 14 extends through the holes of the connecting plates 4*a* and is welded thereto to join the connecting plates 4*a* in a suitably spaced relationship. Each connecting plate 4*a* includes four arms 4*b* radially extending from the pipe 14 to connect a pair of vertically disposed structural members 1 and a pair of horizontally disposed structural members 1 in a cruciform pattern. The projecting core end portion 2*a* of each structural member 1 is interposed between and welded to one of the arms 4*b* of one connecting plate 4*a* and one of the arms 4*b* of the other connecting plate 4*a*. The pipe 14 provides means through which an anchor bolt 8 is driven into the ground 12.

Figure 8:
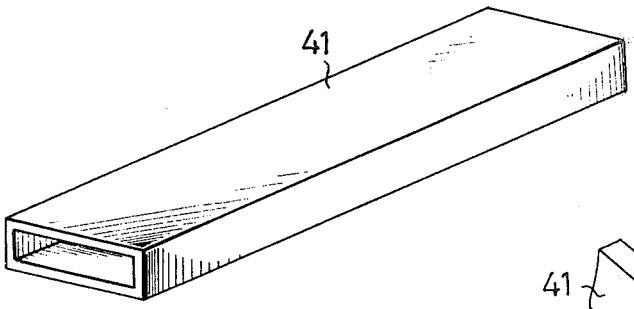
FIG. 8 is a perspective view of another form of the structural member used in the fabrication of the retaining wall of this invention.
Figure 9:
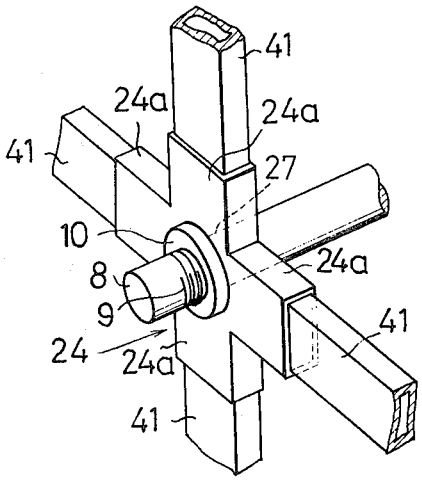
FIG. 9 is a fragmentary perspective view of still another embodiment of this invention.

A structural member of another form is shown in FIG. 8 and comprises an elongate hollow member having a rectangular cross-section. The structural member 41 is made of steel and is given a suitable surface lining treatment. FIG. 9 shows another form of connecting means 24 which is suitable for fabrication of a retaining wall from the structural members 41 of FIG. 8. The connecting means 24 comprises a unitary hollow cross-shaped member and includes a circular hole 27 in the center thereof through which an anchor bolt 8 extends into the ground. The connecting means 24 further includes four arms 24*a* radially extending from the hole 27. Each arm 24*a* has a rectangular hollow cross-section and is open at its free end to receive therein one end of one structural member 41.

Figure 10:
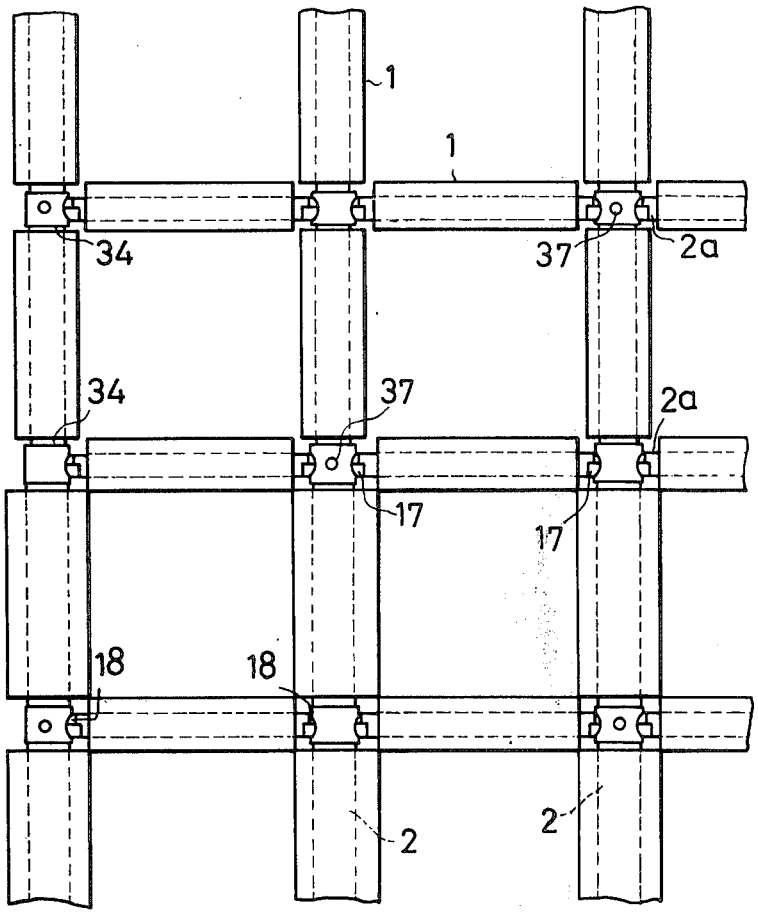
FIG. 10 is a fragmentary front elevational view of a further embodiment of this invention.
Figure 11:
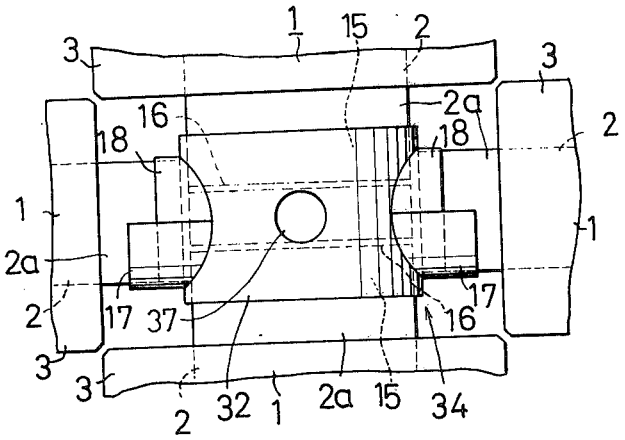
FIG. 11 is a fragmentary enlarged view of the retaining wall shown in FIG. 10.
Figure 12:
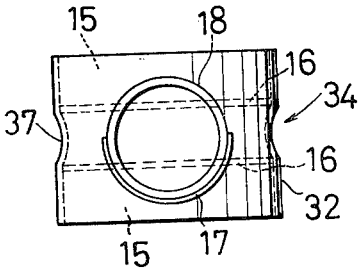
FIG. 12 is a side elevational view in a slightly reduced scale of a portion of the wall shown in FIG. 11.
Figure 13:
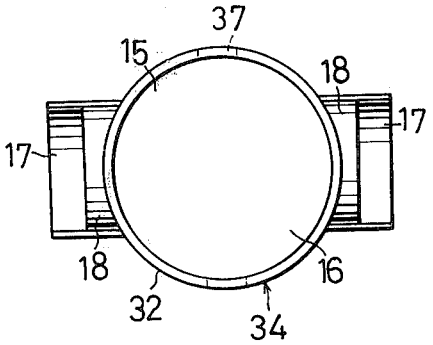
FIG. 13 is a plan view of a portion of the wall shown in FIG. 11.

FIG. 10 shows the retaining wall according to a different embodiment of this invention. The retaining wall of FIG. 10 is fabricated from two different sizes of structural members 1 by employing connecting means 34 which are different from those hereinbefore described. Horizontally disposed structural members 1 are smaller in breadth than vertically disposed ones, and accordingly, the cores 2 of the former are smaller in diameter than those of the latter. Referring to FIGS. 11–13, the connecting means 34 comprises a relatively short cylindrical member 32 which is open at both ends. The cylindrical member 32 has an inner diameter which is equal to the outer diameter of the core end portion 2*a* of one of the vertically disposed structural members 1. The interior of the cylindrical member 32 is divided into three substantially equal hollow spaces by a pair of parallel circular dividing walls 16 extending transversely across the cylindrical member 32. The hollow spaces thus defined include a pair of oppositely disposed sockets 15. The cylindrical member 32 further includes a pair of circular holes 37 which are provided on the opposite sides of the cylindrical member 32 in a diametrically opposite relationship and are positioned between the two dividing walls 16. An anchor bolt 8 extends through the hole 37 to hold the retaining wall to the ground. The connecting means 34 further includes a pair of short cylindrical sockets 18 welded to the outer peripherial surface of the cylindrical member 32 in a diametrically opposite relationship. As is readily understood from FIG. 13, each of the cylindrical sockets 18 is positioned at right angles to the anchor bolt 8 extending through the holes 37. The cylindrical socket 18 is substantially equally spaced from the opposite ends of the cylindrical member 32 and has an inner diameter which is equal to the outer diameter of the core end portions 2*a* of the horizontally disposed structural members 1. In order to ensure that the cylindrical socket 18 be rigidly secured to the cylindrical member 32, each cylindrical socket 18 is formed at one end with a pair of arcuately curved edges extending substantially along the length of the cylindrical member 32. The arcuately curved edges permit welding along the entire circumference of the cylindrical socket 18 at one end thereof. The other end of the cylindrical socket 18 has an ordinary straight edge. A semi-cylindrical flange 17 is applied to each of the cylindrical sockets 18 and surrounds the lower half of the socket 18 in close contact therewith. The flange 17 is formed at one end with a curved edge which is complimentary to the curvature of the outer periphery of the cylindrical member 32 and is welded thereto along the curved edge of the socket 18. The other end of the flange 17 is straight and extends beyond the straight end of the socket 18. The core end portion 2*a* of each of the vertically disposed structural members 1 is received in one of the sockets 15, and the core end portion 2*a* of each of the horizontally disposed structural members 1 is received in one of the sockets 18 and welded to the flange 17, whereby the four structural members 1 are connected with one another in a cruciform pattern as illustrated in FIG. 11.

It is to be understood that although various forms of connecting means have been described and shown as used to connect structural members in a cruciform pattern, any such connecting means used at any extremity of a retaining wall or or at any corner thereof may naturally be modified to suit varying connecting requirements by omitting a portion or portions of the connecting means. Such modification or variation will easily be made by anyone of ordinary skill in the art without departing from the spirit of this invention, and no further description would be necessary.

It is also to be noted that it is not always necessary to use an anchor bolt 8 or its associated components in combination with every connecting means in order to hold a retaining wall to the ground. Some of the joints of a particular retaining wall may do without any anchor bolt to hold the wall fast to the ground. The use of an anchor bolt in combination with a particular joint of the wall depends upon the nature of the ground to be protected.

Although the invention has been described with reference to a few forms thereof, it is to be understood that further modifications or variations may be easily made by those skilled in the art without departing from the scope of this invention which is defined by the appended claims.

What is claimed is:

1. A retaining wall having a grid-shaped structure comprising:

a plurality of elongated structural members, some of which are vertically disposed in a mutually aligned relationship, while the other members are horizontally disposed in a mutually aligned relationship and at right angles to said vertically disposed members, each of said structural members comprising an elongate core and an elongate solid body made of concrete molded around said core and having a rectangular transverse section, said body being smaller in length than said core to allow said core to project from opposite ends of said body, said core projections cooperating with said connecting means to connect said structural members in said overlapping cruciform;

a plurality of means for connecting said vertically aligned structural members and said horizontally aligned structural members together in an overlapping cruciform pattern, said connecting means comprising a pair of parallel connecting plates spaced from each other by a distance equal to the outer diameter of each of said core projections, the plane of each of said connecting plates being perpendicular to the plane of said retaining wall, each of said connecting plates being welded at one end on one surface thereof to the outer periphery of said core projection of one of said vertically disposed structural members, the other end of said connecting plate being welded on said one surface to the outer periphery of said core projection of another vertically disposed structural member, said core projection of one of said horizontally disposed structural members being welded to the outer surface of one of said connecting plates and said core projection of another horizontally disposed structural member being welded to the other surface of the other connecting plate;

a square plate having a side length equal to said outer diameter of said core projections and welded to said one surface of said connecting plates along a pair of opposite side edges, a circular hole being provided in the center of said square plate to define said hole means and centered on an intersection of axes of said vertically and horizontally disposed structural members;

a plurality of elongate anchor means each extending through said hole of one of at least some of said connecting means to hold said retaining wall fast to the ground at the site to be protected; and means for adjustably holding each of said anchor means to one of said connecting means.

2. The retaining wall as defined in claim 1 wherein said core is made of steel pipe.

3. The retaining wall as defined in claim 1 wherein said core is made of a steel channel.

4. The retaining wall as defined in claim 1 wherein said core is made of a round steel bar.

5. The retaining wall as defined in claim 1 wherein said anchor means comprises an elongate round bar threaded at one end.

6. The retaining wall as defined in claim 5 wherein said anchor holding means comprises:

a nut screwed onto said threaded end of said bar; and a washer encircling said bar and interposed between said connecting means and said nut.

7. The retaining wall as defined in claim 6 wherein said washer has a gradually decreasing thickness thereacross, and said hole in said connecting means has a diameter which is somewhat larger than that of said bar.

8. A retaining wall having a grid-shaped structure comprising:

a plurality of elongate structural members, some of which are vertically disposed in a mutually aligned relationship, while the other members are horizontally aligned in a mutually aligned relationship and at right angles to said vertically disposed members;

a plurality of means for connecting said vertically aligned structural members and said horizontally aligned structural members together in an overlapping cruciform pattern, said connecting means comprising:

a first hollow cylindrical member open at both ends and divided into three hollow spaces by a pair of parallel dividing walls extending transversely across the diameter thereof, said core projection of one of said vertically disposed structural members being received in one of said hollow spaces at one end of said cylindrical members and said core projection of another vertically disposed structural member being received in another hollow space at the other end of said cylindrical members, a pair of circular holes being provided in said cylindrical member in a horizontally coaxial relationship, said circular holes being situated between said dividing walls and defining said hole means;

a pair of spaced hollow cylindrical members having an equal diameter which is smaller than that of said first cylindrical member, said second cylindrical member being welded at one end to said first cylindrical member at right angles thereto, said second cylindrical members being coaxial with each other end perpendicular to the axis of said hole means;

a pair of semi-cylindrical flange members each welded at one end to said first cylindrical member and surrounding the lower half of one of said second cylindrical members, the other end of said flange member projecting beyond the other end of said second cylindrical member, said core end projection of one of said horizontally disposed structural members being received in said second cylindrical member and welded to said flange member;

a plurality of elongate anchor means each extending through said hole of one of at least some of said connecting means to hold said retaining wall fast to the ground at the site to be protected;

means for adjustably holding each of said anchor means to one of said anchor means;

each of said structural members comprising:

an elongate core; and an elongate solid body made of concrete molded around said core and having a rectangular transverse section, said body being smaller in length than said core to allow said core to project from the opposite ends of said body, said core projections cooperating with said connecting means to connect said structural members in said overlapping cruciform pattern.

9. The retaining wall as defined in claim 8 wherein said one end of each of said second cylindrical members and said flange members has a curved edge complementary to the outer periphery of said first cylindrical member, while said other end of each of said second cylindrical members and said flange members is straight.

* * * * *